US009422714B2

(12) United States Patent
Miller

(10) Patent No.: US 9,422,714 B2
(45) Date of Patent: Aug. 23, 2016

(54) WOODEN FRAME TRUSS WITH ENHANCED FIRE RESISTANCE

(71) Applicant: UNITED STATES GYPSUM COMPANY, Chicago, IL (US)

(72) Inventor: Gary Franklin Miller, Palatine, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 14/504,660

(22) Filed: Oct. 2, 2014

(65) Prior Publication Data

US 2016/0097196 A1 Apr. 7, 2016

(51) Int. Cl.

| | |
|---|---|
| ***E04C 3/02*** | (2006.01) |
| ***E04B 1/94*** | (2006.01) |
| ***E04B 9/04*** | (2006.01) |
| ***E04B 9/06*** | (2006.01) |
| ***E04C 3/16*** | (2006.01) |
| *E04B 5/12* | (2006.01) |
| *E04B 9/00* | (2006.01) |
| *E04B 9/24* | (2006.01) |

(Continued)

(52) U.S. Cl.

CPC ..... *E04B 1/945* (2013.01); *E04B 9/04* (2013.01); *E04B 9/06* (2013.01); *E04C 3/16* (2013.01); *E04B 5/12* (2013.01); *E04B 9/001* (2013.01); *E04B 9/24* (2013.01); *E04C 3/07* (2013.01); *E04C 2003/0473* (2013.01)

(58) Field of Classification Search

CPC ..... E04C 2003/0491; E04C 3/02; E04C 2003/0413; E04C 2003/0486; E04C 2003/0465; E04B 9/18; E04B 9/001; E04B 9/0435; E04B 9/06; E04B 9/183; E04B 2/723; E04B 9/04; E04B 2001/8281; E04B 1/7654; F16B 15/0023; F16B 5/0685

USPC ..... 52/692, 693

See application file for complete search history.

(56) References Cited

U.S. PATENT DOCUMENTS 1,791,278 A * 2/1931 Lucy ..... 52/692
2,097,722 A * 11/1937 Coddington ..... 52/376

(Continued)

FOREIGN PATENT DOCUMENTS

DE 19714625 A1 10/1998

OTHER PUBLICATIONS

Knauf Gips KG, "K25.de Knauf Fireboard Beam and Column Encasements", System Data Sheet Catalog, Jun. 1, 2013 edition, retrieved Dec. 3, 2015 <http://www.wego-systembaustoffe.de/shopware_wego_static/pdf/vti/technishes_datenblatt/knf/k25_englisch.pdf>.

(Continued)

*Primary Examiner* — Brian Mattei
*Assistant Examiner* — Gisele Ford
(74) *Attorney, Agent, or Firm* — Greer, Burns & Crain, Ltd.; Pradip Sahu; Philip T. Petti

(57) ABSTRACT

A wooden frame truss with enhanced fire resistance is provided and includes an upper chord extending along a longitudinal axis, a lower chord disposed below the upper chord and extending along a vertically displaced, parallel axis, a plurality of supports attached between the upper and lower chords, and a plurality of metal gusset plates securing the supports to the chords. At least one wallboard batten strip is attached to an underside of the lower chord, the strip being constructed and arranged so that the strip defines a ledge extending from each side of the lower chord.

9 Claims, 8 Drawing Sheets

(51) Int. Cl.
*E04C 3/07* (2006.01)
*E04C 3/04* (2006.01)

(56) References Cited

U.S. PATENT DOCUMENTS 4,266,384 A * 5/1981 Orals et al. ..... 52/410
4,862,662 A * 9/1989 Eberle et al. ..... 52/299
2009/0107059 A1* 4/2009 Kipp et al. ..... 52/144
2009/0107072 A1* 4/2009 Bowman et al. ..... 52/404.1

OTHER PUBLICATIONS

PCT Search Report from International Patent Application No. PCT/US2015/050351, mailed Dec. 10, 2015.

* cited by examiner

WOODEN FRAME TRUSS WITH ENHANCED FIRE RESISTANCE

BACKGROUND

The present invention relates generally to wooden frame construction materials and techniques, and more specifically to an open-web wooden truss with enhanced fire resistance.

Since their introduction in about 1960, light timber, open-web wood trusses have become one of the most widely used engineered wood building products employed in commercial construction. According to the Wood Truss Council of America (WTCA), such trusses are lightweight, easy to install, and have nailable chords for easy attachment of roof decking and ceiling materials. Open-webbing provides great benefits to plumbers and electricians, without the need to spend time cutting holes in floor members. Less cutting reduces jobsite labor and reduces potentially critical errors that could result in compromising the structural integrity of the components. Open-web wood trusses are lighter, less expensive and can be stronger than large, single "closed web" support members.

When subject to fire damage, the weak link or cause of failure of such open-web trusses is the detachment of the metal gusset plates used to connect the framing members together. Under load, as the wood chars and the metal gusset plates heat up under fire, the teeth of the metal gusset plates lose strength and holding power. The loss of the gusset plate on the bottom chord of a truss can lead to tensile forces pulling the truss apart. The loss of a gusset plate on the top chord will cause any web members attached to the top chord to pull away. Both situations will significantly reduce the load-carrying capacity of the installed truss and may even lead to a truss collapse.

Thus, engineered building components provide adequate strength under normal loading, but under fire conditions, these truss systems can fail, leading to the collapse of roof, floors, and possibly the entire structure. Truss systems are usually hidden, and fires within truss systems can go undetected for long periods of time, resulting in loss of structural integrity prior to discovery of the fire. Structural design codes often do not factor in the decreased system integrity as the fire degrades the structural members. Accordingly, there is a need for open-web truss systems having enhanced fire resistance.

SUMMARY

The above-identified need is met by the present open-web wooden truss assembly, in which approximately six-inch wide gypsum wallboard batten strips are attached to a lower surface of the lower chord of the truss. The width of the strip compared to the approximate 4-inch width of the chord, means that the wallboard batten strips extend laterally beyond edges of the chord. In this manner, a fire resistant barrier is created that protects both the chord from charring, and the metal gusset plates from degrading due to the intense heat generated by the fire. In addition, the batten strips also provide a ledge of approximately 1 inch extending away from, and along each edge of the chord, creating a support platform for insulation installed prior to the fabrication of the wallboard ceiling. It has been found that a ceiling made from trusses equipped with the present batten strips, and having a ceiling of two layers of fire rated ⅝ inch gypsum wallboard fastened to the strips, successfully resisted charring by fire for at least two hours.

A preferred construction system using the present truss includes the truss with the batten strip along the lower chord, insulation strips inserted between trusses and supported by the ledges defined by the batten strips, then RC-1 sound attenuation channels secured transversely to the batten strips, so that the batten strips are acoustically decoupled from the wallboard ceiling boards attached to the RC-1 channels. The gypsum wallboard ceiling panels or boards are then secured to the RC-1 channels, as is well known in the art. Preferably two thicknesses of ceiling boards are attached to the RC-1 channels.

More specifically, a wooden frame truss with enhanced fire resistance is provided and includes an upper chord extending along a longitudinal axis, a lower chord disposed below the upper chord and extending along a vertically displaced, parallel axis, a plurality of supports attached between the upper and lower chords, and a plurality of metal gusset plates securing the supports to the chords. At least one wallboard batten strip is attached to an underside of the lower chord, the strip being constructed and arranged so that the strip defines a ledge extending from each side of the lower chord.

In another embodiment, a ceiling system is provided, and includes a plurality of wooden frame trusses with enhanced fire resistance, each truss including an upper chord extending along a longitudinal axis, a lower chord disposed below the upper chord and extending along a vertically displaced, parallel axis, a plurality of supports being attached between the upper and lower chords. A plurality of metal gusset plates secures the supports to the chords. At least one wallboard batten strip is attached to an underside of the lower chord, each strip being constructed and arranged so that the strip defines a ledge extending from each side of the lower chord. At least one length of insulation is inserted between adjacent beams and supported by the ledges, and at least one RC-1 strip is secured to an underside of each batten. In addition, at least one wallboard panel is secured to the at least one RC-1 strip.

DETAILED DESCRIPTION

Figure 1A:
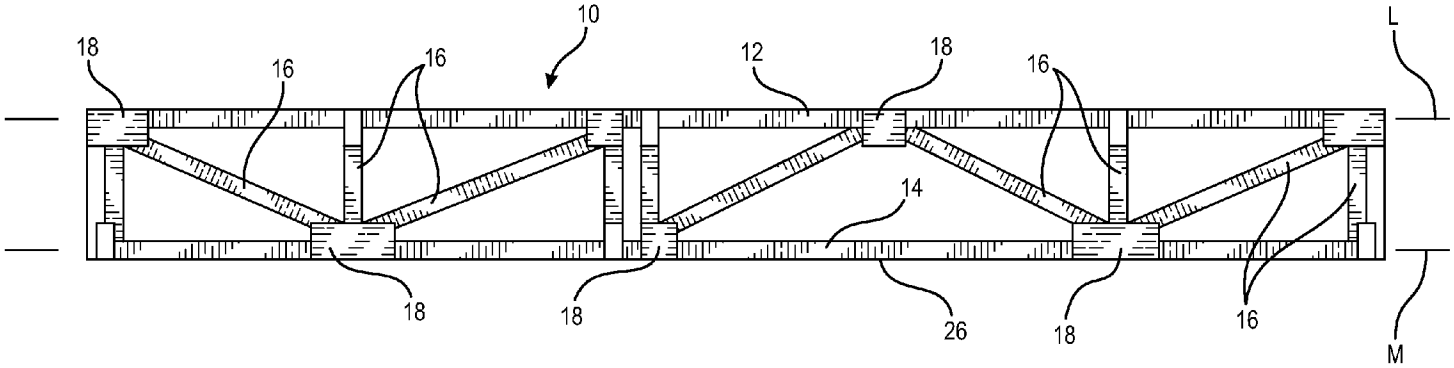
FIG. 1A PRIOR ART
FIG. 1A is a side elevation of a conventional open-web wooden truss.

Referring now to FIG. 1A, a conventional open-web wooden truss is generally designated 10. Such trusses are typically used for supporting a floor of a building, such as, but not limited to commercial buildings or residences, especially multi-story, multi-family residences. The truss 10 includes an upper chord 12 extending along a longitudinal axis "L." The chord 12 is typically made of a 2×4 board commonly used in residential and commercial construction. A lower chord 14 is disposed along an axis "M", extending in a vertically spaced, generally parallel orientation to the chord 12. A plurality of structural supports, also referred to as supports 16 are located between the upper and lower chords 12, 14 and are secured to the chords. As is the case with the upper chord 12, the lower chord 14 and the supports 16 are preferably made of 2×4 lumber, however other sizes for all of these components are contemplated depending on the situation.

As is known in the art, metal gusset plates 18 are used for securing the supports 16 to the associated chords 12, 14. The plates 18 are provided with a plurality of pointed teeth (not shown) for gripping the wood, and are hammered or pressed in place during construction of the truss 10. As described above, during fire conditions, conventional trusses 10 have been known to fail, in part due to charring of the chords 12 and 14, and also to the deterioration of the gusset plates 18, which results in the supports 16 detaching from the chords, and the structural failure of the truss.

Figure 1B:
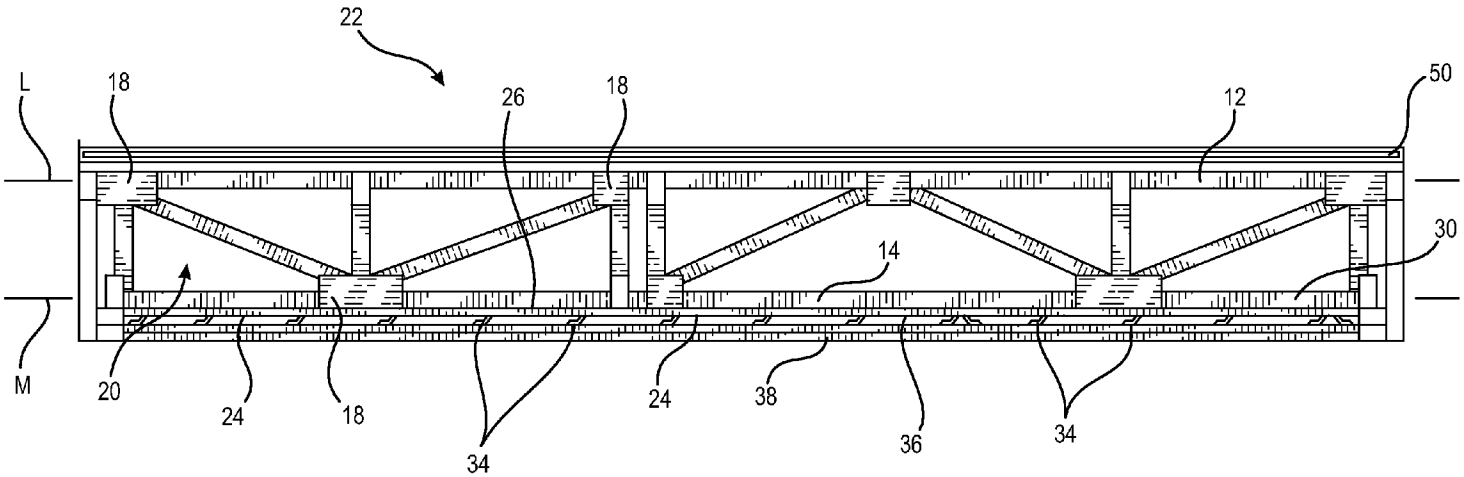
FIG. 1B is a side elevation of the present ceiling system having enhanced fire resistance and including the present truss.
Figure 1C:
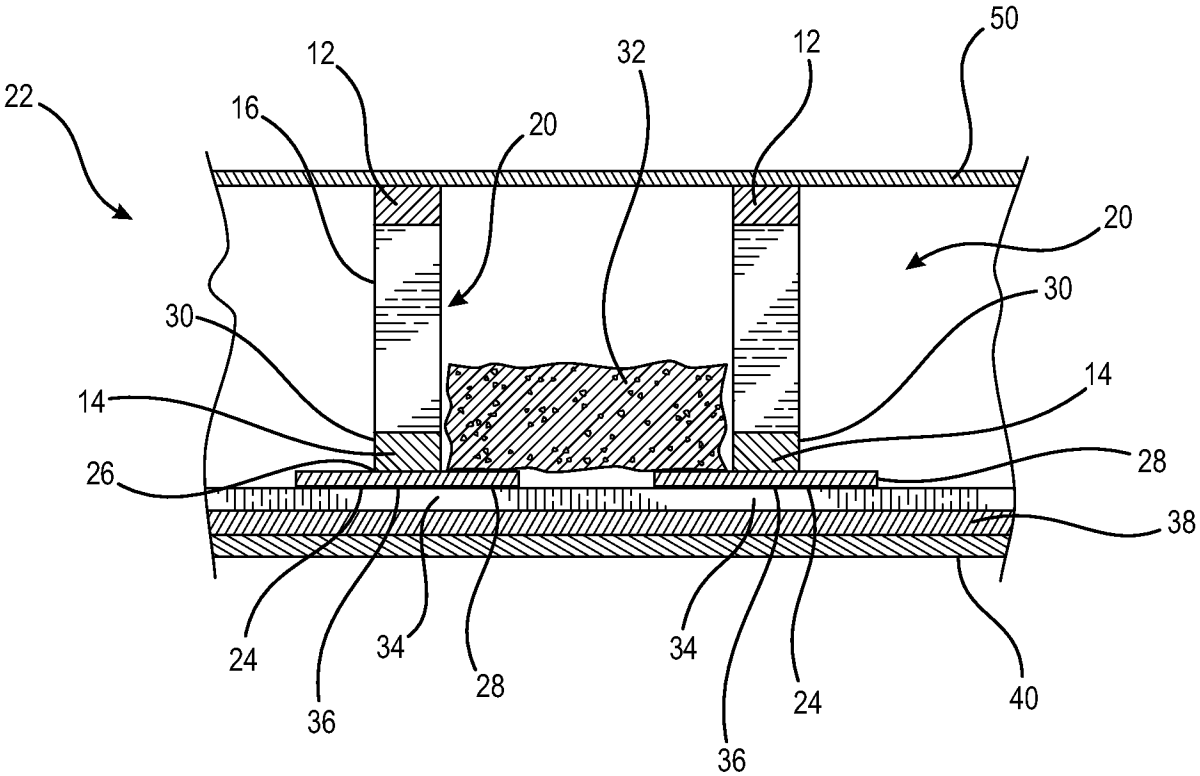
FIG. 1C is a fragmentary end view of the present ceiling system shown in FIG. 1B.
Figure 2:
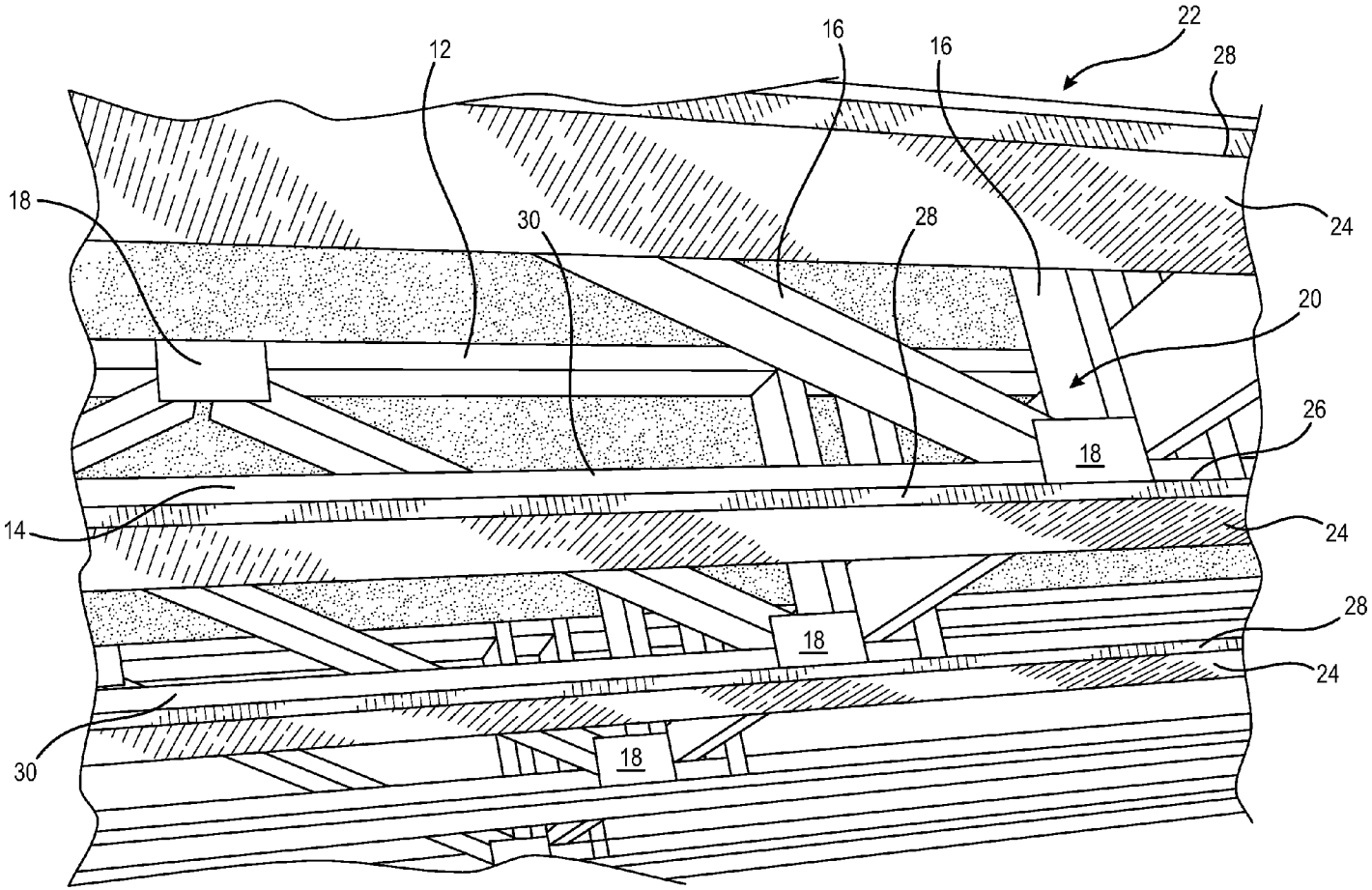
FIG. 2 is a bottom perspective view of the ceiling of FIG. 1B under construction using the present open-web wooden trusses.

Referring now to FIGS. 1B, 1C and 2, an open-web wooden truss with enhanced fire resistance according to the present invention is generally designated 20, and is depicted as part of a ceiling system, generally designated 22. Components shared with the truss 10 are depicted in the truss 20 using identical reference numbers.

A main distinguishing feature of the truss 20 is the attachment of at least one wallboard batten strip 24 to an underside 26 of the lower chord, 14. Each batten strip 24 is preferably cut from a conventional gypsum wallboard panel, having a thickness of either ½ or ⅝ inch depending on the application. In width, each batten strip 24 is approximately 6-8 inches, however the width may vary to suit the application. Each batten strip 24 is constructed and arranged so that the strip defines a ledge 28 extending from each side 30 of the lower chord 14. It is preferred that the chord 14 is generally centered upon the batten strip 24, so that the ledges 28 extending from each side 30 are relatively equal to each other. In an embodiment, the ledges 28 extend one inch from the corresponding sides 30, however it is contemplated that the distance extending from the side may vary to suit the application. Further, it is preferred that the batten strips 24 extend coextensively along a length of the lower chord 14.

Figure 3:
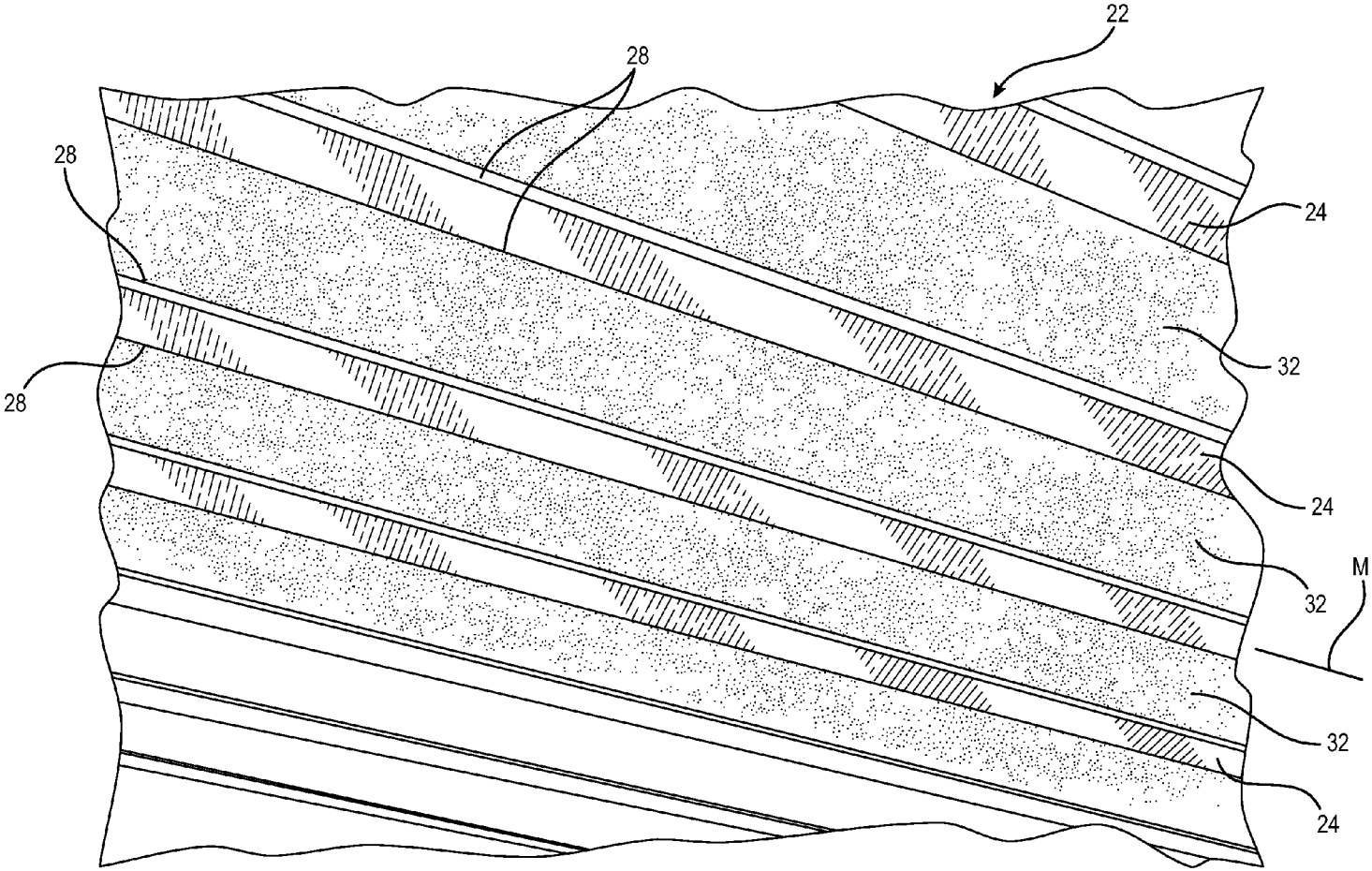
FIG. 3 is a bottom perspective view of the present trusses assembled in a ceiling, and strips of insulation installed between the trusses.

Referring now to FIGS. 1C and 3, an advantage of the ledges 28 is that they provide a support location for lengths or bats or strips of insulation 32, typically fiberglass, however other types of conventional ceiling insulation are contemplated. Using the present trusses 20, the strips of insulation 32 are easily installed and retained without supplemental fastening between adjacent ledges 28, facilitating the creation of a heat and sound insulating barrier.

Figure 4:
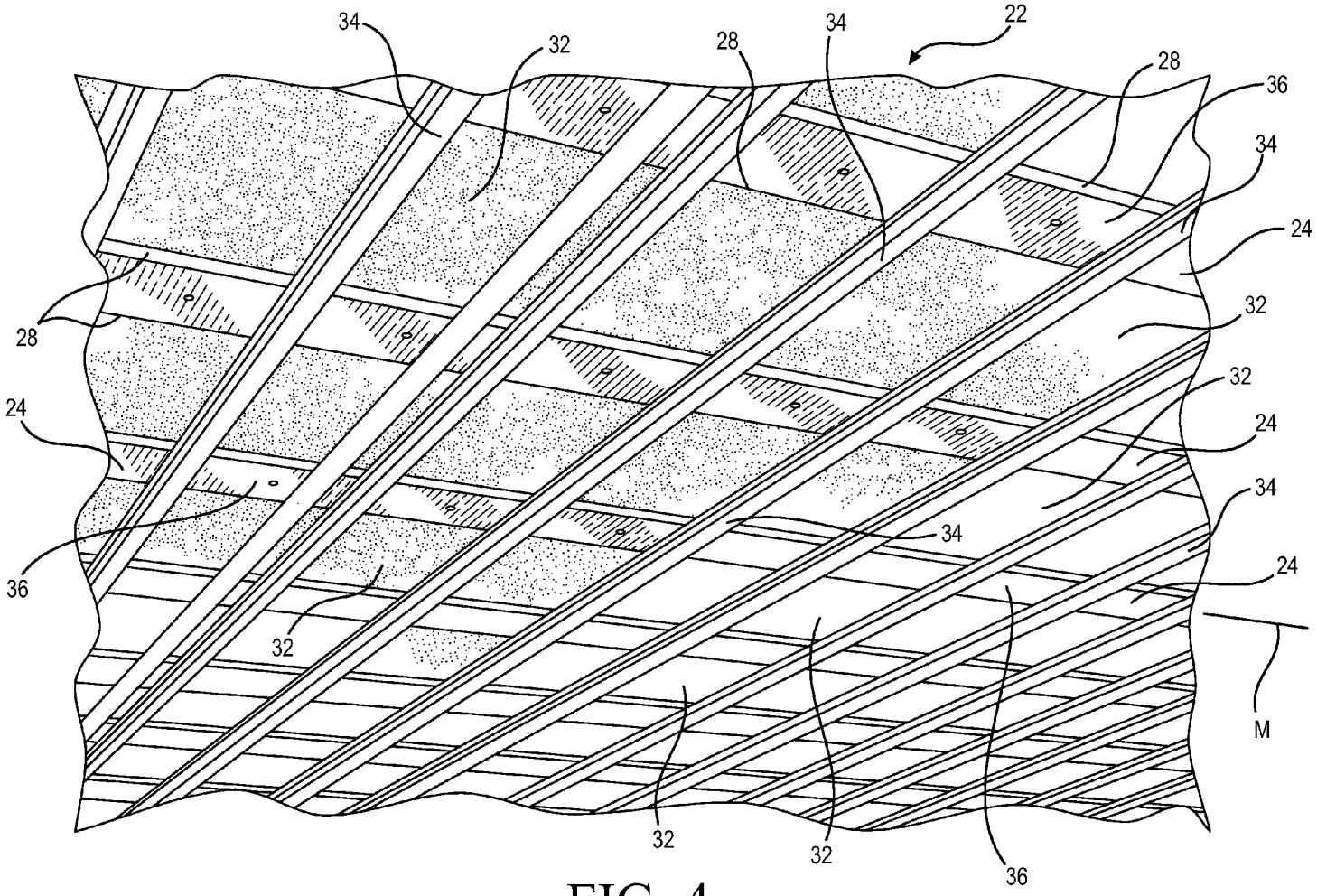
FIG. 4 is a bottom perspective view of the ceiling of FIG. 1B under construction, with RC-1 channels secured to the battens.

Referring now to FIGS. 1B, 1C and 4, beneath the batten strips 24 are attached a plurality of spaced, parallel RC-1 acoustical decoupling channels 34. The RC-1 channels 34 are fastened to an underside 36 of the batten strips 24 using threaded fasteners or the like, as is known in the art, and extend in a direction that is normal to the longitudinal axes "L" and "M".

Figure 5:
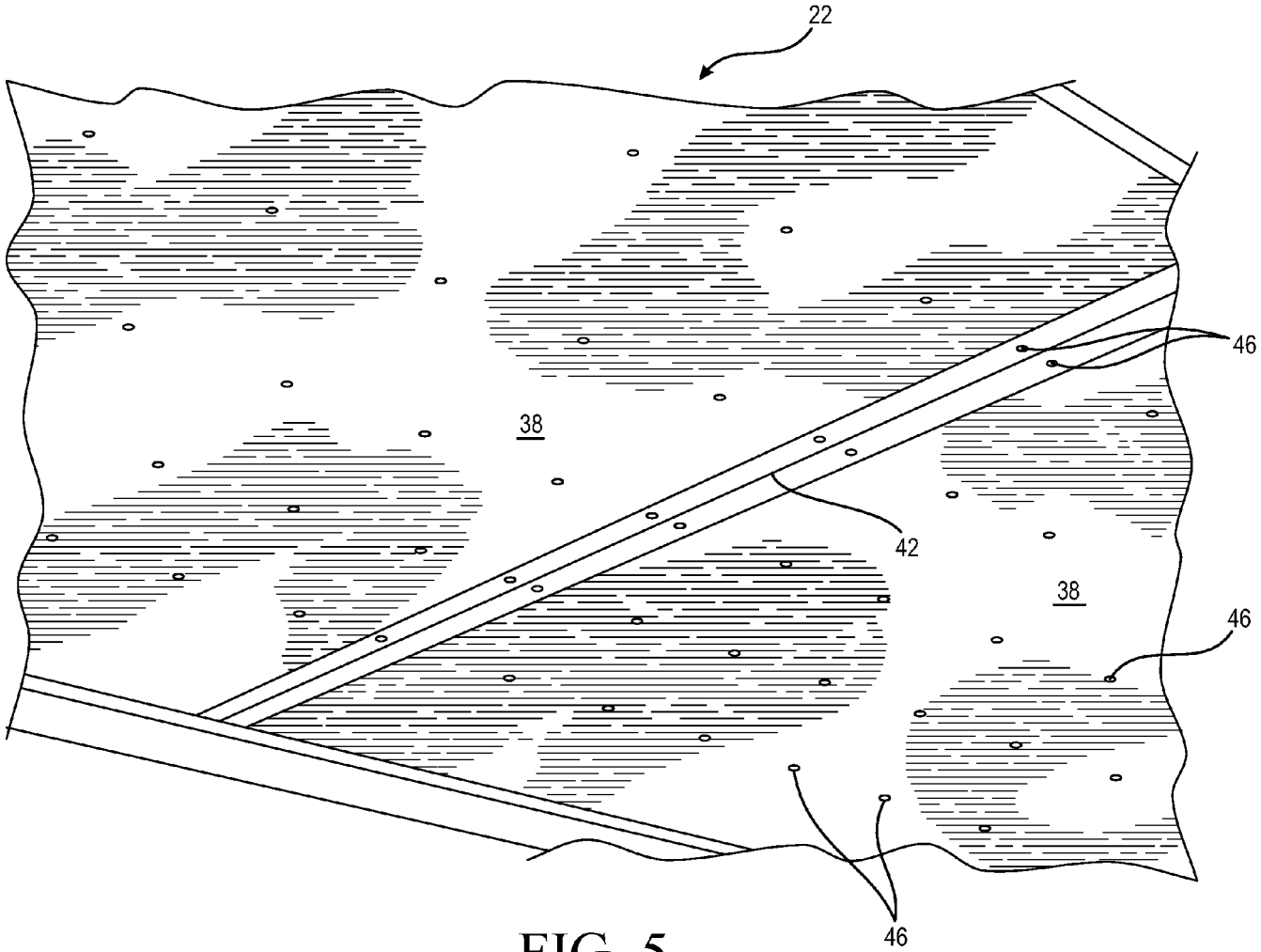
FIG. 5 is a bottom perspective view of the present ceiling with a first layer of wallboard ceiling panels secured to the RC-1 channels.

Referring now to FIGS. 1B, 1C and 5, at least one, and preferably a plurality of wallboard ceiling panels 38 are secured to the at least one RC-1 channels 34. Since the panels 38 are fastened to the RC-1 channels and not to the trusses 20, they are acoustically decoupled from the trusses, and provide a quieter environment for the living space below the ceiling system 22.

Figure 6:
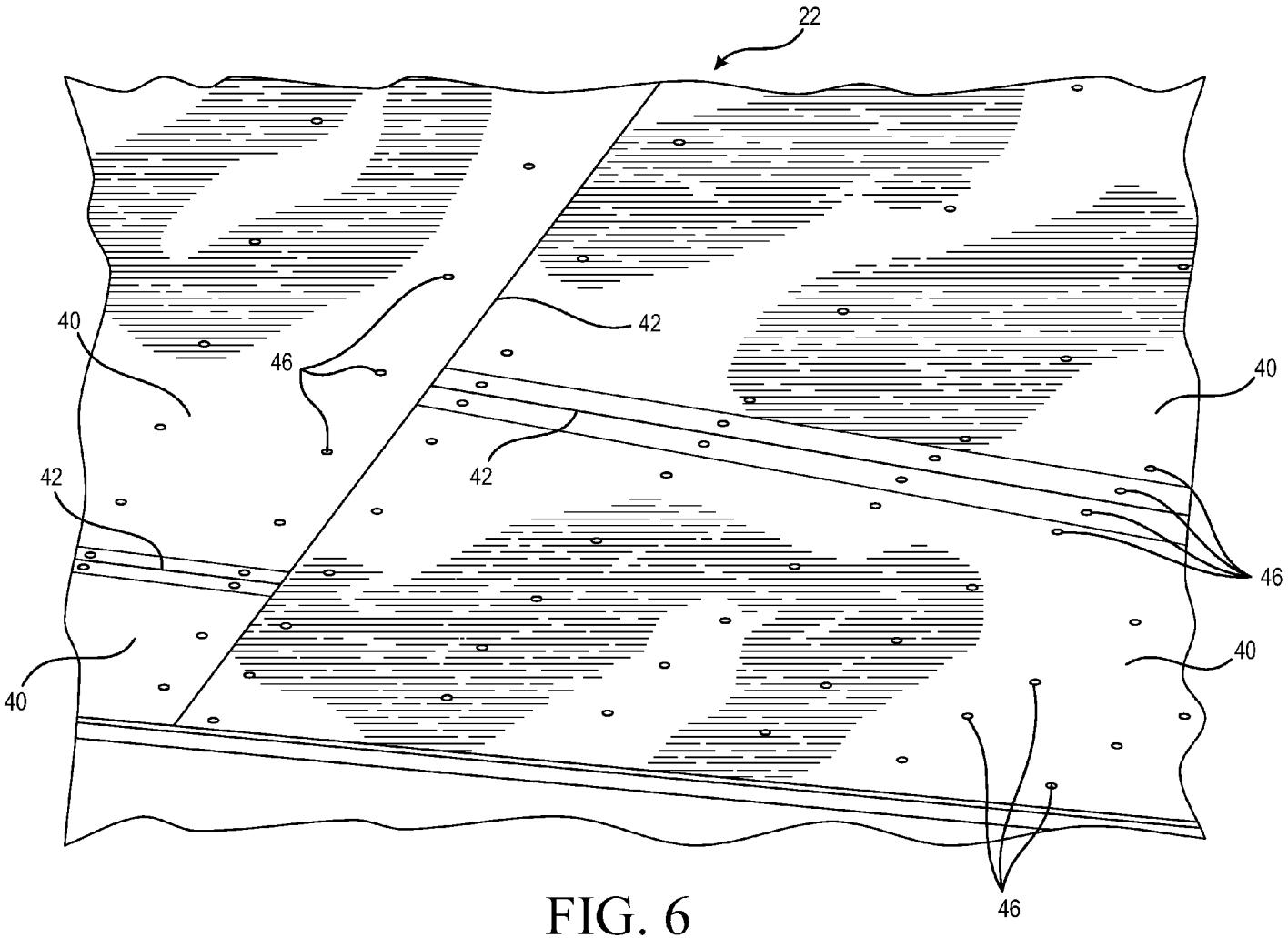
FIG. 6 is a bottom perspective view of the present ceiling with a second layer of wallboard ceiling panels secured to the first layer and to the RC-1 channels.
Figure 7:
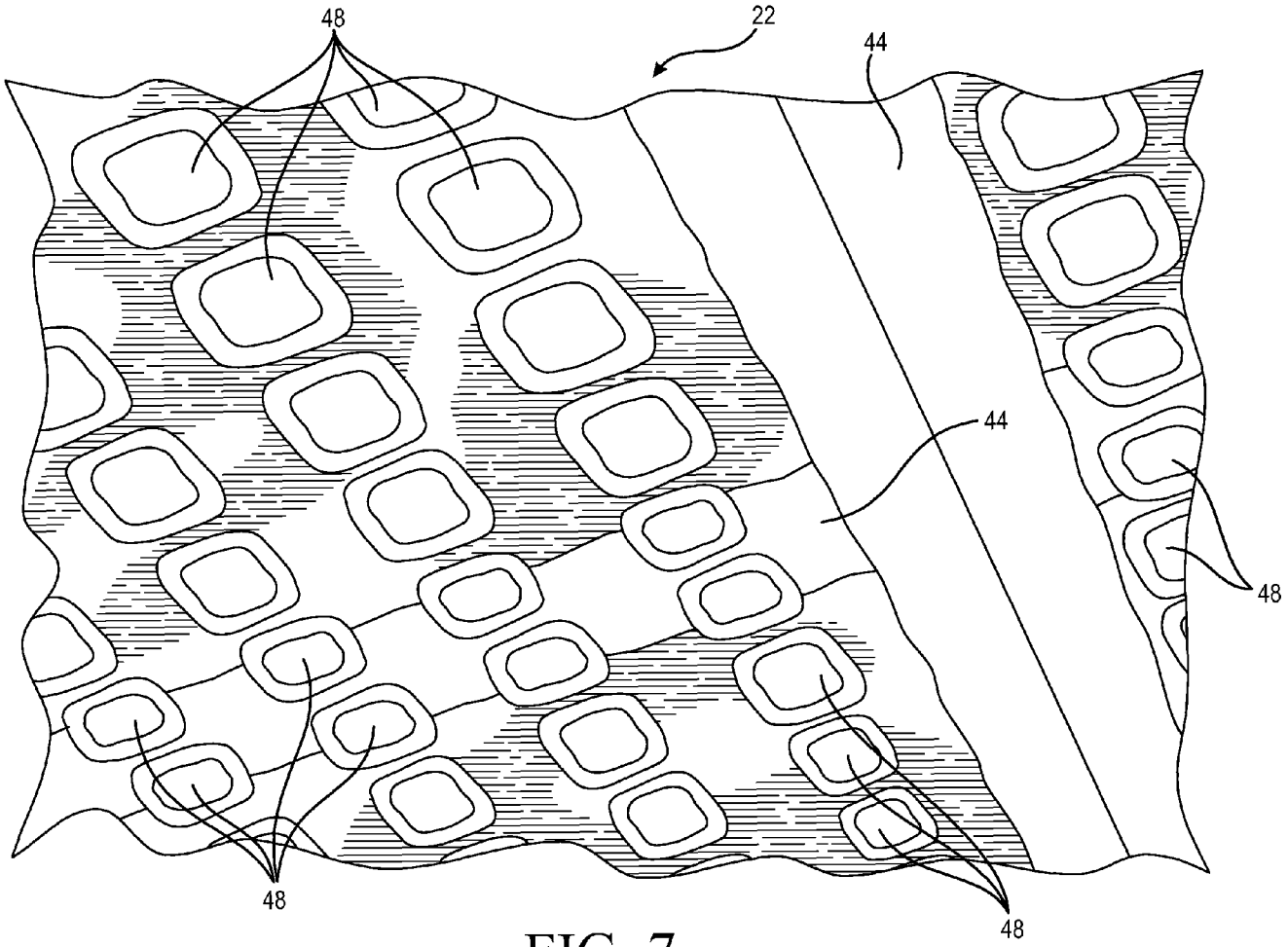
FIG. 7 is a bottom perspective view of the present ceiling showing the wallboard taped and ready for painting.

Referring now to FIGS. 1C and 6, in a preferred embodiment, a second layer of wallboard ceiling panels 40 is fastened both to the RC-1 channels 34 and to the first layer of panels 38. As is well known in the art, the panels 40 are installed to be oriented normally to the panels 38. Upon installation of the panels 40, a resulting double thick layer of ceiling panels creates a further fire resistant barrier for the ceiling system 22. Also, as is known in the art, seams 42 between adjacent panels 40 are taped at 44, and fastener holes 46 are covered with joint compound 48 as seen in FIG. 7.

Referring again to FIG. 1B, the truss 20 supports a subfloor 50, including a layer of plywood and optionally poured underlayment, as is known in the art.

Tests of the present system 22 including the truss 20 have shown that the system withstands fire for at least two hours. The test procedure was performed at the Western Fire Center, Inc., Kelso, Wash. The test procedure was pursuant to ASTM E119 and employed a modified construction described in Underwriters Laboratory design assembly L577. The testing was performed using a horizontal fire resistance test furnace employing the fire endurance conditions and standard time-temperature curve described in ASTM E119. Temperature measurements were taken inside the natural gas furnace using 9 thermocouples ($TC_f$) connected to a computerized data acquisition. $TC_f$ locations were symmetrically disposed and distributed to show the temperature near the exposed face of the test assembly.

According to the test criteria the system/assembly will have sustained the applied load for the indicated two hour time without passage of flame or gases hot enough to ignite cotton waste; and transmission of heat through the assembly will not have resulted in a temperature rise of more than 139° C./250° F. above its initial temperature, or if a temperature higher than 30% (181° C./325° F. of the specified limit occurs at any one point on the unexposed side of the assembly.

In the test, on the underside of the lower chord 14 bottom of each truss 20 was applied a 6 in. (2¾ inch on exterior rim support) gypsum batten strip (same material that was used for the ceiling), initially fastened with #6 2¼ in. screws at 12" on center. Full strips (10') and short strips (3') were alternately placed over each truss. Unfaced fiberglass insulation (Owens Corning ProPink® R-11, M44) strips were loosely laid on top of the batten strips, each strip of insulation being 3⅝×20 in. The density of the insulation was 0.49 lb./ft.$^3$. Steel (25GA) resilient channels (RC) were fastened with #6 screws perpendicular to the underside of the batten strip at 12 in. on center, alternating between screws already fastened into the batten strip. The RC channel was located so that the perpendicular gypsum (butt) joint for the exposed face could be fastened 2 in. in both directions (4 in. total) with a 4 in. overlap splice. The ceiling (exposed side below trusses) was lined with two layers of USG ⅝ in. SHEETROCK® Brand Gypsum Panels, FIRECODE® fire rated C Core, which was supplied in 4'×10' lengths before being cut to size. The measured mass and average thickness of the butt and tapered edge of the gypsum were 2.49±0.01 lb./ft.$^2$, 0.63±0.01 in., and 0.58±0.01 in., respectively.

Gypsum panels were installed perpendicular to the underside of the RC and fastened with Type S steel screws (1 in. and 1⅝ in.) spaced 8 in. on center and located 1 in. from the tapered edge and ½ in. and 2 in. from the butt joint edge for the base and face layers, respectively. All exposed gypsum joints were taped (2 in.) and covered with two layers of dry mix joint compound. The exposed nail heads were also covered with two layers of compound.

A superimposed load was applied to the assembly provide a distributed load of 51.56 lb./ft., or a combined live (40 lb./ft.$^2$) and dead (23.5 lb./ft.$^2$) load on the top chord of 63.5 lb./ft.$^2$. The loading of the assembly was accomplished by 20 weighted barrels (581.6 lb./barrel or 11,632 lb. total), each placed upon two 50 in., nominal 4×4 wood bunks, evenly spanned over three trusses (5 barrels spanning 4'×14.10'). This load applied was the calculated maximum theoretical load permitted by nationally recognized design standards. The deflection of the floor assembly was measured with one linear voltage displacement transducer (LVDT) located at the geometric center of the assembly.

After the furnace exposure and test termination, the fire was extinguished with water. Some of the gypsum wallboard had fallen away due to the extinguishment, but the RC and batten strips remained in place, with some bowing of the RC mid-cavity. Much of the fiberglass insulation was still in place with deterioration on the bottom, but largely whole on the top. A few gusset plates were observed to be pulling from the trusses, and the lower chord was charred, although no charring was observed on the bottom of the subfloor. The 2¼ inch screws and batten strips were sufficient to hold the RC and wallboard in place for the duration of the test.

The floor/ceiling assembly passed the requirements for the 2-hr fire endurance test, according to ASTM E119, Standard Test Methods for Fire Tests of Building Construction and Materials. The fire resistance assembly had a finish rating of 100 min., rounding to the nearest integral minute. The floor/ceiling assembly did not allow flames to pass through the assembly for the 125 min. based from when the test was terminated. There was no unexposed temperature failure for average or single-point thresholds (139° C. +ambient, 181° C. +ambient) during the 125 min. test. Therefore, this assembly was considered certifiable for a 2 hr. 5 min resistance time.

While a particular embodiment of the present wooden frame truss with enhanced fire resistance has been shown and described, it will be appreciated by those skilled in the art that changes and modifications may be made thereto without departing from the invention in its broader aspects and as set forth in the following claims.

What is claimed:

1. A wooden frame truss with enhanced fire resistance for use in a ceiling system including a plurality of said trusses mounted in spaced parallel relation to each other, each said truss comprising:

an upper wooden chord extending along a longitudinal axis;

a lower wooden chord disposed below the upper chord and extending along a vertically displaced, parallel axis, a plurality of wooden supports attached between said upper and lower chords;

a plurality of metal gusset plates securing said supports to said chords; and at least one gypsum wallboard batten strip attached directly to an underside of said lower chord, said strip being dimensioned to have a width in the general range of 6-8 inches to define a ledge extending from each side of said lower chord, such that a space is defined between ledges of adjacent trusses, and enhanced fire resistance is provided by said batten strip being attached to said lower chord, said batten strip being a separate component from gypsum wallboard panels used to create a ceiling attached to said truss, such that upon said truss being assembled in the ceiling system, with a plurality of said trusses, and having lengths of insulation supported by said ledges formed by said gypsum wallboard batten strips of the adjacent trusses, said ceiling system resists charring by fire for at least two hours.

2. The truss of claim 1 wherein said ledge extends at least one inch from each said side of said chord.

3. The truss of claim 1, wherein said batten strips extend along a length of said lower chord, and are coextensive with said chord.

4. The truss of claim 1, wherein said batten strips are secured to said lower chord so that the chord is generally centered relative to said batten, such that said batten extends laterally generally equally from each side of said chord.

5. A ceiling system, comprising:

a plurality of wooden frame trusses with enhanced fire resistance, each said truss including:

an upper wooden chord extending along a longitudinal axis;

a lower wooden chord disposed below the upper chord and extending along a vertically displaced, parallel axis, a plurality of wooden supports attached between said upper and lower chords;

a plurality of metal gusset plates securing said supports to said chords;

at least one gypsum wallboard batten strip attached directly to an underside of said lower chord, each said gypsum wallboard batten strip being constructed and arranged so that said gypsum wallboard batten strip defines a ledge extending from each side of said lower chord;

at least one length of insulation inserted between adjacent trusses, being placed upon and supported by said ledges such that said length of insulation extends between said adjacent trusses;

at least one RC-1 strip secured to an underside of each said wallboard batten strip; and two layers of gypsum wallboard panels secured to said at least one RC-1 strip to form a ceiling, such that said at least one gypsum wallboard batten strip, which is a separate component from said gypsum wallboard panels, provides enhanced fire resistance, wherein upon assembly, said ceiling system, with a plurality of said trusses, and having lengths of insulation supported by said ledges formed by said gypsum wallboard batten strips of the adjacent trusses, resists charring by fire for at least two hours.

6. The ceiling system of claim 5, wherein said ledges extend generally equally from each said side of said lower chord.

7. The ceiling system of claim 5, wherein said ledges extend approximately one inch from each said side of said lower chord.

8. The ceiling system of claim 5, wherein panels of each said layer of gypsum wallboard extend in a direction normal to panels in the other layer.

9. The ceiling system of claim 5, wherein each said batten strip has a width in the general range of 4-6 inches.

* * * * *